US005415415A

United States Patent [19]

Mujic

[11] Patent Number: 5,415,415

[45] Date of Patent: May 16, 1995

[54] OPTICALLY IMPROVED TARGET

[76] Inventor: John Mujic, 173 Conklin Ave., Patchogue, N.Y. 11772

[21] Appl. No.: 220,191

[22] Filed: Mar. 30, 1994

[51] Int. Cl.[6] ..... F41J 1/00

[52] U.S. Cl. ..... 273/409; 273/408; D22/113

[58] Field of Search ..... 273/408, 409, 403, 404, 273/348; D22/113

[56] References Cited

U.S. PATENT DOCUMENTS

| | | | |
|---|---|---|---|
| D. 211,467 | 6/1968 | Wilbur | D22/113 |
| D. 259,357 | 5/1981 | Dulude | D22/113 |
| D. 289,532 | 4/1987 | Ivie | D22/113 |
| 3,118,674 | 1/1964 | Curren | 273/409 |
| 5,066,020 | 11/1991 | Trudeau | 273/408 |

FOREIGN PATENT DOCUMENTS

| | | | |
|---|---|---|---|
| 2139514 | 11/1984 | United Kingdom | 273/409 |

*Primary Examiner*—Mark S. Graham
*Attorney, Agent, or Firm*—Michael I. Kroll

[57] ABSTRACT

The present invention relates to an improved target for shooting projectiles thereon having a plurality of alternating colored concentric rings terminating at a centering colored bull's eye having an alternately colored to said bull's eye, an alternately colored inverted diamond, a plurality of perpendicularly arranged interspersing within and between adjacent alternating colored concentric rings alternating colored bars having an opposing color to said alternating color of said concentric ring, and said alternating colored concentric rings, said oppositely alternating colored perpendicularly arranged interspersing bars, and said alternately colored centrally located bull's eye having a central located oppositely colored inverted diamond contained therein functioning in combination to narrowly focus a person's eye toward the center of a target when a shooter aligns gun sites thereon.

8 Claims, 2 Drawing Sheets

OPTICALLY IMPROVED TARGET

BACKGROUND OF THE INVENTION

1. Field of the Invention

The present invention relates to gun targets, and more particularly to small arms disposable targets.

The invention relates to targets comprising multiple target elements which are uniquely displaced from their normal positions to improve visual awareness.

This invention relates to a gun target which is capable of easily collecting soft projectiles. The conventional target is printed with some concentric circles, and/or divided into areas in different sizes so that scores can be indicated by the areas into which the projectiles form holes. The targets are mostly designed for bullets, and are not suitable for improved visual centering on the bull's eye.

2. Description of the Prior Art

The typical target for practice or competition in the shooting of small arms such as pellet guns, hand guns, and rifles, consists of a sheet of heavy paper on which one or more graphics patterns is printed, e.g., with a so-called "bulls-eye" or the like. Under many conditions of lighting or background behind the target, the hole produced by the fired round is difficult to visualize at a distance. Especially with a pellet or small caliber bullet, the hole in the paper partly re-closes. As a result, the marksman cannot, without seeing the holes, accurately adjust his aim.

The novel feature of this invention is to design of a target to accept the projectiles, with increased visual focusing on the center bull's eye.

Several targets have been developed utilizing the individual target elements. In some of these devices, exemplified by U.S. Pat. Nos. 996,712 and 1,098,255, the individual target elements are struck out of the line of fire and are retained in that position by a catch mechanism until the last target is struck, releasing the other targets to return to the pre-firing position under action of gravity. Another target, disclosed in U.S. Pat. No. 3,411,784, utilizes a master target which when struck releases any previously-struck secondary targets, all targets then returning to the original position, under the force of gravity.

There is a need for a simple, reliable, and rugged target that is visually enhanced to allow the shooter to easily focus on the center bulls eye of the target.

The present invention is a target comprising a combination of concentric rings which are alternatively colored having alternating colored interspersed bars between the rings and an inverted diamond shaped bull's eye in the center of the target.

U.S. Pat. No. 5,275,890 Gun Target with Contrasting Backing C. Steven Wolf and David Mucci A gun target including a substantially planar first sheet having a back surface and an exposed front surface which carries a graphic pattern having a first color, at which the weapon is aimed. A substantially planar second sheet is connected to the back surface of the first sheet so as to lie substantially parallel to the first sheet. The second sheet has a front surface that has a second, contrasting color relative to the first color. When a round fired from the weapon into the graphic pattern penetrates both sheets, the resulting hole exposes the second color at the front surface of the first sheet.

U.S. Pat. No. 4,824,120 Toy Gun Target Board Capable of Collecting Soft Projectiles Hsieh Y. Wang and S. De Anza A toy gun target board device mainly comprises a box body, a movable plate disposed inside the box body and a spring provided between the movable plate and bottom plate of the box body. A score board with holes equally and properly spaced is disposed on the surface of the box body. The movable plate has extensions to form ejection portions that extend out through openings at the upper part of both sides of the box body. A plurality of sticks corresponding in number and position to the holes on the score board are disposed on the movable plate, and individually extend out through the holes toward the users. A receiving tray is formed at the lower part of the box body for collecting soft projectiles.

IMPACT-RIGHTING GUN TARGET Robert H. Davidson and Donald A. Reisch

An impact-righting target for small bore rifle practice and the like comprising a central master target element and two secondary target elements all being pivoted on a common axis and normally spring-biased into an upright position exposed to the line of fire. Upon being struck by projectiles, the secondary targets pivot rearwardly out of the line of fire and are detained in this position by releasible leaf spring detents. The master target is provided with cams which disengage the leaf spring detents when the master target is pivoted rearwardly by the impact of a projectile, thus enabling the secondary targets to return to the upright position.

Numerous innovations for drafting devices have been provided in the prior art that are adapted to be used. Even though these innovations may be suitable for the specific individual purposes to which they address, they would not be suitable for the purposes of the present invention as heretofore described.

SUMMARY OF THE INVENTION

It is an object of the present invention to provide a target that improves the visibility of the target's bull's eye and holes caused by the penetration of the round through the target. This is accomplished by providing a target comprising a combination of concentric rings which are alternatively colored having alternating colored interspersed bars between the rings and an inverted diamond shaped bull's eye in the center of the target at which the weapon is aimed. The combination of contrasting colors, alternating colored bars and an inverted diamond shaped bull's eye facilitates a shooters focus on the bull's eye for positioning of the gun sites. When a round fired from the weapon into the graphic pattern penetrates the target, the resulting hole exposes the background color at the front surface of the target.

In one embodiment, the target is fluorescent paper, preferably with contrasting colored concentric rings and bars.

In another embodiment, the target is paper or plastic.

The invention includes a target with a surface on which there are fully provided with concentric rings equably spaced with each other. The spaces defined by the bars and inverted diamond shape focus one's eye to the center of the target. The inside bull's eye having an inverted diamond shape in contrasting colors. A plurality of bars are interspersed between the rings. Thus, the present invention provides a target for guns which can easily and quickly focus one's eye to the center bull's eye without reducing the interests of the users.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

10—visually improved target
12—typical target
14—shooting range
16—wide focus of sight
18—narrow focus of sight
20—gun
22—shooter
24—shooter's eye
26—shooting hand
28—balancing hand
30—front site
32—rear site
34—target holder
36—typical concentric rings
38—typical bull's eye
40—visually improved concentric ring
42—bars
44—visually improved bull's eye
46—inverted diamond
48—concentric ring number
50—number 7 dark colored visually improved concentric ring
52—number 8 light colored visually improved concentric ring
54—number 9 dark colored visually improved concentric ring
56—number 10 light colored visually improved concentric ring

DETAILED DESCRIPTION OF THE PREFERRED EMBODIMENT

Figure 1:
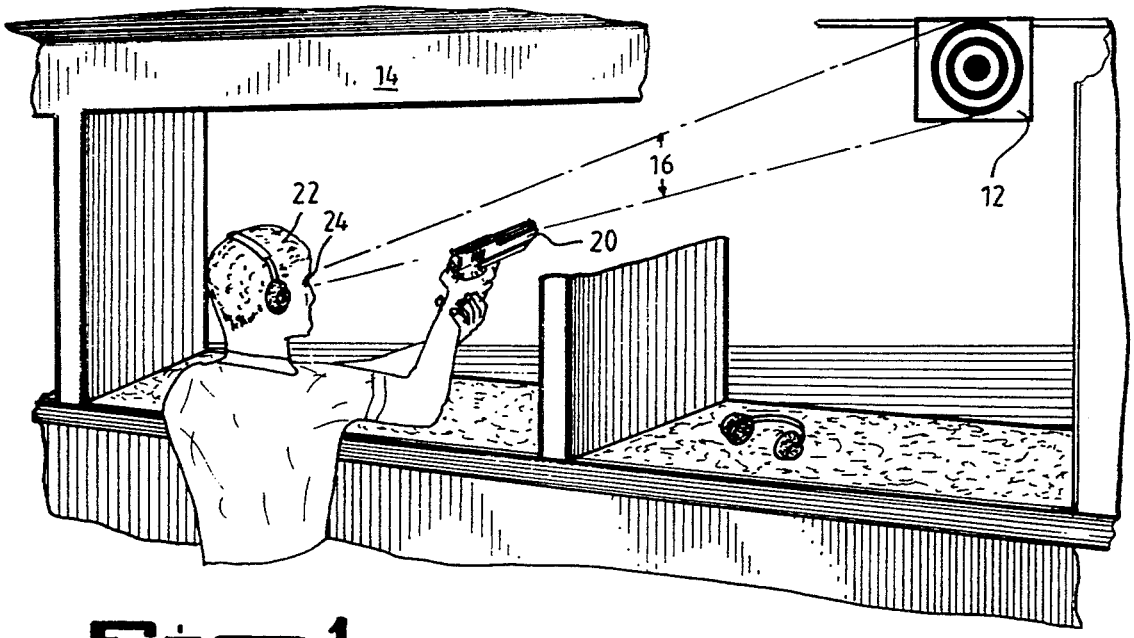
Fig. 1 (PRIOR ART)
FIG. 1 is a perspective view of a typical shooting range whereas the target is positioned at the far end of the range.

Referring to FIG. 1 which is a perspective view of a typical shooting range 14 whereas the target 12 is positioned at the far end of the range 14. The shooter 22 visualizing the target 12 thought the sites of his gun 20 with his eye 24 exhibits a wide focus of site 16 due to the typical target 12 configuration of concentric rings.

Figure 2:
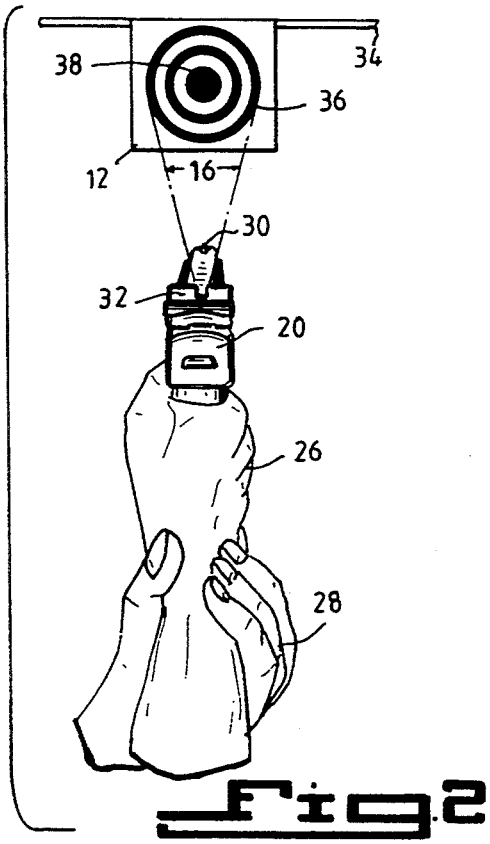
Fig. 2 (PRIOR ART)
FIG. 2 is a forward facing perspective view of a persons line of sight which exhibits a typical target and the wide eye focusing of the concentric rings.

Referring now to FIG. 2 which is a forward facing perspective view of a persons line of sight which exhibits a typical target 12 attached to a target holder 34 and the wide focus of sight 16 of the typical concentric rings 36. It is clearly exhibited in FIG. 2 that when a shooter 22 holding a gun 20 in his shooting hand 26 using a balancing hand 28 to reduce movement and improve alignment looks forwardly through his rear site 32 in line with his front site 30 to align the sites up with the target 12 and more particularly with the typical bull's eye 38, a shooter's eye 24 has a wide focus of sight encompassing the entire target 12 and not solely the typical bull's eye 38.

Figure 3:
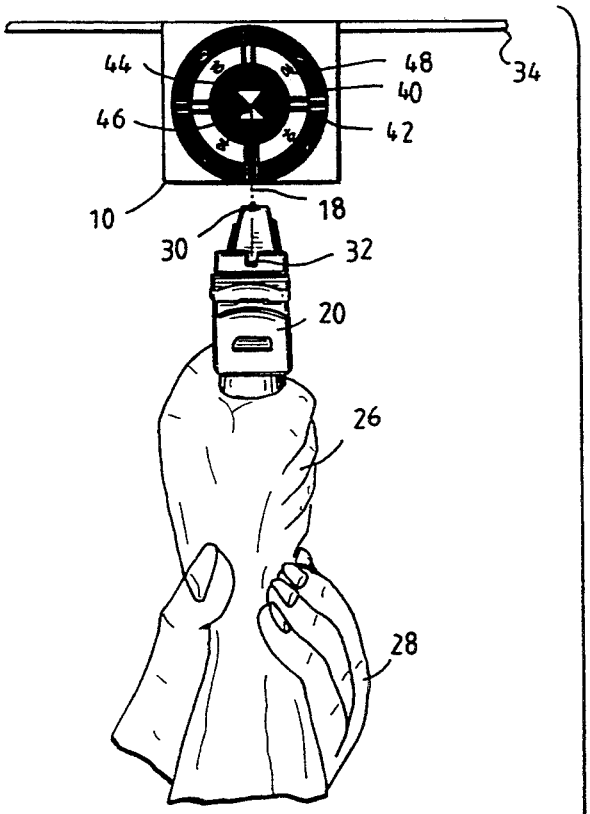
FIG. 3 is a forward facing perspective view of a persons line of sight which exhibits a visually improved target and the narrow eye focusing to the center position of the concentric rings.

Referring now to FIG. 3 which is a forward facing perspective view of a persons line of sight which exhibits a visually improved target 10 attached to a target holder 34 and the narrow focus of sight 18 of the visually improved concentric rings 40. It is clearly exhibited in FIG. 3 that when a shooter 22 holding a gun 20 in his shooting hand 26 using a balancing hand 28 to reduce movement and improve alignment looks forwardly through his rear site 32 in line with his front site 30 to align the sites up with the visually improved target 10 and more particularly with the visually improved bull's eye 44, which a shooter's eye 24 has a narrow focus of sight encompassing solely the visually improved bull's eye 44 located at the center of the visually improved target 10 and unlike the wide focus of sight 16 exhibited by a typical target 12. The improved visually improved target 10 is ergonomically designed to enhance the middle portion of the target by the utilization of visually enhancing features such as alternating dark colored and light colored visually improved concentric rings 40 which are interspersed by alternating dark colored and light colored bars 42 having a dark colored visually improved bull's eye 44 containing therein a light colored inverted diamond 46 which functions to concentrate the focus of the eye directly in the center of the visually improved target 10. The visually improved concentric rings 40 have concentric ring numbers 48 which are arranged with the larger numbers toward the center and the smaller numbers toward the outside to facilitate scoring of shots fired.

Figure 4:
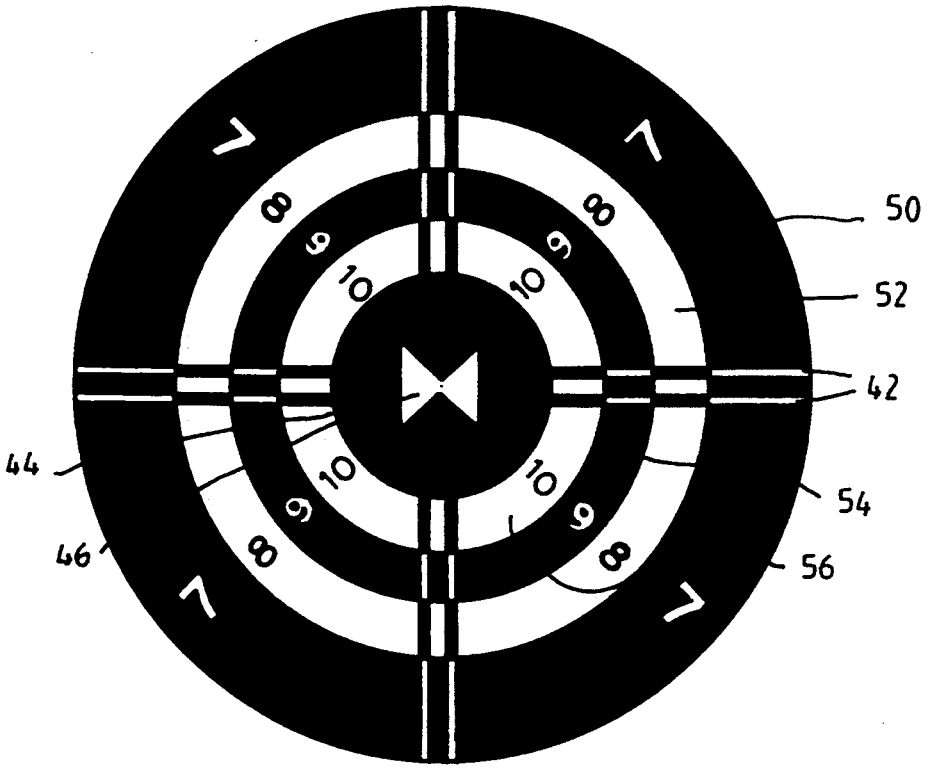
FIG. 4 is a front view of a visually improved target exhibiting alternating colored concentric rings, bars and a center inverted diamond.

Referring now to FIG. 4 which is a front view of a visually improved target, 10 exhibiting alternating colored concentric rings 40, bars 42 and a center inverted diamond 46. The improved visually improved target 10 is ergonomically designed to enhance the middle portion of the target by the utilization of visually enhancing features such as alternating dark colored and light colored visually improved concentric rings 40 which are interspersed by alternating dark colored and light colored bars 42 having a dark colored visually improved bull's eye 44 containing therein a light colored inverted diamond 46 which functions to concentrate the focus of the eye directly in the center of the visually improved target 10. The visually improved concentric rings 40 have number 7 dark colored visually improved concentric ring 50, number 8 light colored visually improved concentric ring 52, number 9 dark colored visually improved concentric ring 54, number 10 dark colored visually improved concentric ring 56 which are concentric ring numbers 48 which are arranged with the larger numbers toward the center and the smaller numbers toward the outside to facilitate scoring of shots fired.

Figure 5:
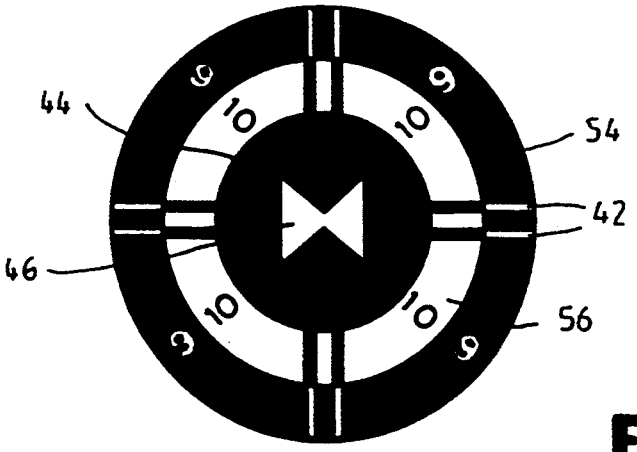
FIG. 5 is an enlarged front view of the center portion of a visually improved target exhibiting alternating colored concentric rings, bars and a center inverted diamond.

Referring now to FIG. 5 which is an enlarged front view of the center portion of a visually improved target 10 exhibiting alternating colored concentric rings 40, bars 42 and a center inverted diamond 46. The improved visually improved target 10 is ergonomically designed to enhance the middle portion of the target by the utilization of visually enhancing features such as alternating dark colored and light colored visually improved concentric rings 40 which are interspersed by alternating dark colored and light colored bars 42 having a dark colored visually improved bull's eye 44 containing therein a light colored inverted diamond 46 which functions to concentrate the focus of the eye directly in the center of the visually improved target 10. The visually improved concentric rings 40 have number 7 dark colored visually improved concentric ring 50, number 8 light colored visually improved concentric ring 52, number 9 dark colored visually improved concentric ring 54, number 10 dark colored visually improved concentric ring 56 which are concentric ring numbers 48 which are arranged with the larger numbers toward the center and the smaller numbers toward the outside to facilitate scoring of shots fired.

Concentric rings 40 may be elliptical, square, triangular, or polygonal in shape. They also may be black and white, flourescent, primary colors, or pastel colors.

It will be understood that each of the elements described above, or two or more together, may also find a useful application in other types of constructions differing from the type described above.

While the invention has been illustrated and described as embodied in a visually improved target, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A visually improved target comprising:

a) a plurality of alternating colored concentric rings terminating at a centering colored bull's eye shaped in the form of an inverted diamond, b) a plurality of perpendicularly arranged pairs of parallel spaced bars passing through said rings and changing to contrasting colors in each ring, and c) said alternating colored concentric rings, said perpendicularly arranged bars, and said centrally located bull's eye functioning in combination to narrowly focus a person's eye toward the center of a target when a shooter aligns gun sites thereon.

2. A visually improved target as described in claim 1, whereas said alternating colored concentric rings are black and white.

3. A visually improved target as described in claim 1, whereas said alternating colored concentric rings are flourescent.

4. A visually improved target as described in claim 1, whereas said alternating colored concentric rings are primary colors.

5. A visually improved target as described in claim 1, whereas said alternating colored concentric rings are pastel colors.

6. A visually improved target as described in claim 1, whereas said concentric rings are round.

7. A visually improved target as described in claim 1, whereas said concentric rings contain numbers thereon functioning to facilitate scoring.

8. A visually improved target as described in claim 7, whereas said numbers are arranged in increasing order from an outside concentric ring toward said centrally located bull's eye.

* * * * *